US005185104A

United States Patent [19]

Horie

[11] Patent Number: 5,185,104

[45] Date of Patent: Feb. 9, 1993

[54] METHOD OF TREATMENT OF HIGH-LEVEL RADIOACTIVE WASTE

[75] Inventor: Misato Horie, Mito, Japan

[73] Assignee: Doryokuro Kakunenryo Kaihatsu Jigyodan, Tokyo, Japan

[21] Appl. No.: 789,528

[22] Filed: Nov. 8, 1991

Related U.S. Application Data

[63] Continuation of Ser. No. 467,519, Jan. 18, 1990, abandoned.

[30] Foreign Application Priority Data

Jan. 28, 1989 [JP] Japan ..... 1-19224

[51] Int. Cl.[5] ..... G21F 9/08; G21F 9/14

[52] U.S. Cl. ..... 252/632; 252/626; 252/630; 264/0.5; 423/2; 423/19; 23/294 R; 159/DIG. 12

[58] Field of Search ..... 252/630, 632, 626, 627; 423/2, 4, 5, 7, 19; 264/0.5; 23/294 R; 203/DIG. 11; 159/DIG. 12; 55/80, 82, 267

[56] References Cited

U.S. PATENT DOCUMENTS

| | | | |
|---|---|---|---|
| 2,773,736 | 12/1956 | Hollingsworth | 23/14.5 |
| 2,944,878 | 7/1960 | Jacqué et al. | 23/294 |
| 2,977,194 | 3/1961 | Loeding et al. | 23/142 |
| 3,136,627 | 6/1964 | Caldwell, Jr. et al. | 75/63 |
| 3,310,500 | 3/1967 | Kelly | 252/301.1 |
| 4,275,045 | 6/1981 | Anav et al. | 423/249 |
| 4,395,367 | 7/1983 | Rohrmann et al. | 252/629 |

FOREIGN PATENT DOCUMENTS

| | | | |
|---|---|---|---|
| 817861 | 8/1959 | United Kingdom | 423/19 |

*Primary Examiner*—Donald P. Walsh
*Assistant Examiner*—Chrisman D. Carroll
*Attorney, Agent, or Firm*—Wenderoth, Lind & Ponack

[57] ABSTRACT

A method of treatment of a high-level radioactive waste comprising heating the radioactive waste at a high temperature of about 500° to 3000° C. to vaporize part of the elements contained in the radioactive waste, and cooling the resultant vapor to separately collect the elements. In one embodiment, the heating step is replaced by a reduction-heating step wherein heating is carried out in the presence of a reducing agent, e.g. hydrogen. In another embodiment, the heating step may be followed by the reduction-heating step.

7 Claims, 1 Drawing Sheet

METHOD OF TREATMENT OF HIGH-LEVEL RADIOACTIVE WASTE

This application is a continuation of now abandoned application Ser. No. 07/467,519 filed on Jan. 18, 1990.

BACKGROUND OF THE INVENTION

The present invention relates to a method of treatment of a high-level radioactive waste generated, for example, from reprocessing of spent nuclear fuels. In particular, it relates to a method for treating a high-level radioactive waste which comprises heating the radioactive waste at a high temperature, separating part of the elements contained in the radioactive waste by utilizing sublimation or boiling of each element in its various chemical forms during the heating step, and recovering a resultant residue as a solidified material.

The high-level radioactive waste generated from reprocessing of the spent fuels contains transuranium elements and Tc (technetium) having long half-lives; Cs (cesium) and Sr (strontium) that are noteworthy elements from the aspect of treatment, storage and disposal because they are responsible for the major proportion of heat generation; and valuable platinum group metals such as Ru(ruthenium), Rh(rhodium) and Pd(palladium). It is therefore very important to separate and recover them prior to solidification of the waste, and to utilize them as a radiation source, a heat generation member and a noble metal, from the point of view of effectively utilizing resources.

The following three methods are heretofore known as prior art techniques for recovering these elements from the high-level radioactive waste:

1) A solvent extraction method wherein the intended nuclides are separated by using a special solvent from the high-level radioactive waste generated from the reprocessing steps;

2) An ion-exchange method wherein the intended nuclides are separated by using an ion-exchange resin from the high-level radioactive waste generated from the reprocessing steps; and 3) A lead extraction method for platinum group elements wherein lead is added to glass at the time of the glass melting step of a vitrification process to thereby move platinum group elements to molten lead and separate them with the molten lead.

However, these prior art techniques described above are not free from the following disadvantages, respectively:

1) Since a new-type solvent is introduced to the reprocessing step in the additional solvent extraction method, the solvent treatment step becomes complicated and efficiency of the main solvent extraction step lowers conseqently.

2) Flammable materials are produced when the ion-exchange resin comes into contact with a nitric acid solution of the radioactive waste. Therefore, the ion-exchange method involves safety problems.

3) The lead extraction method for platinum group elements in the vitrification process can separate the platinum group elements but secondary treatment is necessary in order to extract them from lead.

Furthermore, none of these prior art methods can reduce the volume of the high-level radioactive waste at a high rate, whichever method may be employed.

SUMMARY OF THE INVENTION

It is therefore an object of the present invention to provide a method for treatment of a high-level radioactive waste which solves the problems with the above-described prior art techniques and can separate and recover valuable elements in the radioactive waste in an extremely simple manner.

It is another object of the present invention to provide a method of treatment of a high-level radioactive waste which does not generate a secondary waste and can obtain a highly volume-reduced solidified material.

According to the present invention, in order to accomplish the above-described objects, there is provided a method of treatment of a high-level radioactive waste comprising heating the radioactive waste at a high temperature to vaporize part of the elements contained in the radioactive waste, and cooling the resultant vapor to collect the elements.

In one embodiment of the present invention, the radioactive waste is reduction-heated at a high temperature to vaporize part of the elements contained in the radioactive waste, and the resultant vapor is then cooled to collect the elements.

The high-level radioactive waste is ordinarily a nitric acid solution obtained as an extraction residue in the reprocessing step of spent nuclear fuels, and contains almost all of the nuclear fission products and actinides in spent nuclear fuels. In the present invention, the nitric acid solution is heat-treated so as to evaporate the moisture and nitric acid in the solution and to obtain a calcined material, which is further heated at a temperature ranging from about 500° to about 3,000° C. and more preferably, from about 1,000° to about 2,500° C.

According to another embodiment of the present invention, in a first stage treatment, those elements which sublimate or boil in the form of oxides are heat-treated at a normal or reduced pressure to vaporize those elements. The resultant vapor is then cooled by a plurality of cooling/collecting units whose temperatures are differently set so as to correspond to sublimation or boiling points of each compound or element, thereby collecting the respective elements separately. In a second stage treatment, the remaining high-level radioactive waste is heated in the presence of a reducing agent such as hydrogen to reduce the radioactive waste, and those elements which sublimate or boil in the form of metal are vaporized. The resultant vapor is then cooled, in the same manner as in the first stage treatment, by the cooling/collecting units whose temperatures are set so as to correspond to sublimation or boiling points of the respective elements, thereby collecting the respective elements separately. Needless to say, those elements which are reduced to metals during heating in the first stage treatment can be separated by sublimation or boiling without reduction in the second stage treatment.

A voloxidation method is known as a technique for removing radioactive materials from spent fuels but this method is merely directed to non-metallic elements such as krypton, iodine, tritium and the like. The present invention is directed to metallic elements and not only removes radioactive materials with high boiling points by heating the high-level radioactive waste at a high temperature, but also can remove both Cs and Sr, that are high heat-generation elements and pose problems during disposal, by combining the heat-treatment with the reduction reaction.

The resultant residue comprises metals or a mixture of the metals and oxides, and can be recovered as a volume-reduced high-level radioactive solid.

Almost all of the elements have boiling points or sublimation points different from those of other elements. Some elements contained in the high-level radioactive waste have a relatively low sublimation point or boiling point in the form of an oxide or metal. For example, the boiling point is 690° C. for metallic cesium, 311° C. for technetium oxide, 765° C. for metallic cadmium and 1,384° C. for metallic strontium. By utilizing the difference in these boiling points, therefore, each valuable element can be separated and recovered by heat-treating the high-level radioactive waste at a high temperature to obtain the oxides thereof or by reducing them by hydrogen or the like to obtain metals, causing their sublimation or boiling, and cooling stepwise the resulting vapor ,mixture at the predetermined temperatures.

After the removal of Cs and Sr, the amount of heat generated from the high-level solid waste is reduced to about 10% and therefore the burying density for disposal can be improved drastically. Incidentally, if Cs alone is removed, the amount of heat generation becomes only 50% and a large effect cannot be expected. The boiling points of oxides of Sr are at least 2,430° C. and that of metallic Sr is 1,384° C. as described above. Accordingly, strontium can only be separated by the method of the present invention wherein the heating step is combined with the reduction reaction.

Incidentally, vaporization of each element can be effected at a lower temperature if the heating step or the reduction-heating step is carried out under a reduced pressure.

PREFERRED EMBODIMENTS OF THE INVENTION

Figure 1:
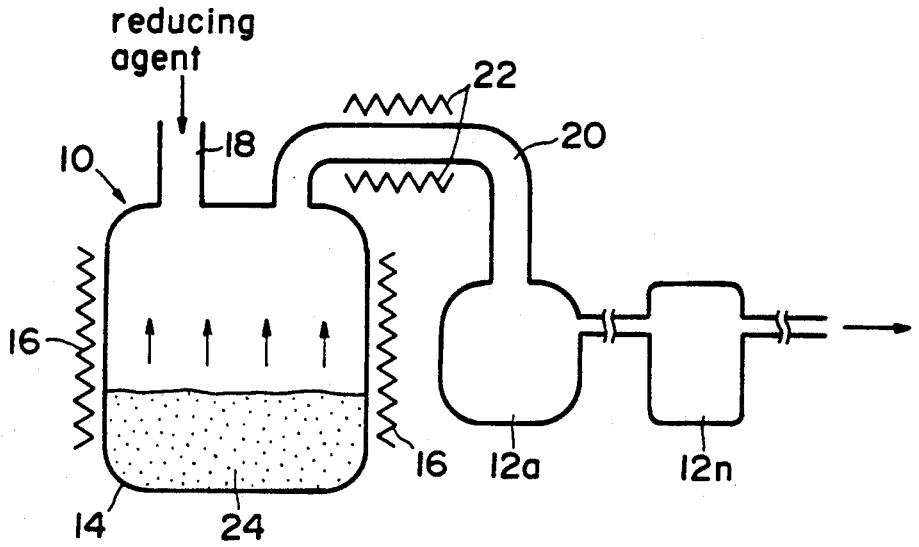
FIG. 1 is a conceptual view showing an example of an apparatus suitable for practising the method of the present invention.

FIG. 1 is a conceptual view of an apparatus used for practising the method of the present invention. The apparatus is equipped with a heat-treatment unit 10 and a plurality of cooling/collecting units 12*a*, . . . , 12*n* connected to the former. The heat-treatment unit 10 includes a heating vessel 14 and a heat-generation member 16. A feed port 18 for a reducing agent is provided at the upper part of the heating vessel 14 and a vapor passage 20 is interposed between the vessel 14 and the cooling/collecting unit 12*a*. A heat-generation and insulating member 22 is fitted around the vapor passage 20.

The heating vessel 14 may be made of a refractory metal such as tungsten or a ceramic material such as alumina or high chromium refractory brick, depending on the heat-treatment temperatures. Besides external heating by supplying power to the heat generation member 16 shown in FIG. 1, high-frequency heating, microwave heating, heating by directly flowing electric current through the high-level radioactive waste or the like may be employed as the heating method. It is also important to utilize effectively the heating due to the decay heat of the high-level radioactive waste to be treated.

The high-level radioactive waste 24 to be treated is charged into the heating vessel 14 and heated. This radioactive waste 24 is, for example, a calcined material obtained by heating a nitric acid solution generated from the reprocessing step of the spent nuclear fuels to evaporate the moisture and nitric acid. The heat-treatment in the heating vessel can of course be carried out continuously from the state of the nitric acid solution. The calcined material is heated to about 500° C. to about 3,000° C., more preferably to about 1,000° C. to about 2,500° C. The elements contained in the calcined material are vaporized due to heating at their sublimation or boiling points in accordance with their chemical forms and are sent to the cooling/collecting units 12*a*, . . . , 12*n* through the vapor passage 20. Each of these elements that are vaporized is individually cooled and collected by each of cooling/collecting units 12*a*, . . . , 12*n* whose temperature is controlled so as to correspond to a sublimation or boiling point of each compound or element.

Though heating may be carried out at a normal pressure, it is preferably carried out under a reduced pressure from the aspect of energy efficiency because the sublimation or boiling point drops and heat-treatment can be made at a lower temperature.

In a preferred embodiment of the present invention, those elements which sublimate or boil in the form of oxides are heat-treated under a normal or reduced pressure and separated in the first stage treatment. The remaining high-level radioactive material is then heated in the second stage treatment while a reducing agent is introduced through the feed port 18 to reduce the radioactive material and to separate those elements which sublimate or boil in the form of metal. Finally, the resultant residue inside the heating vessel 14 is recovered. Hydrogen gas, carbon, carbon monoxide or the like may be used as the reducing agent to be introduced through the feed port 18.

Figure 2:
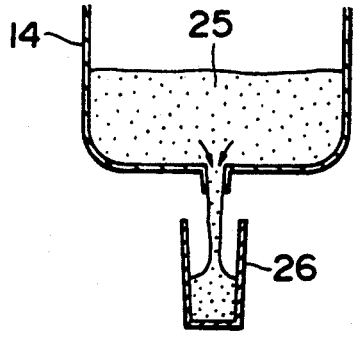
FIG. 2 is an explanatory view showing a discharge method for a residual molten material using a bottom flow system.
Figure 3:
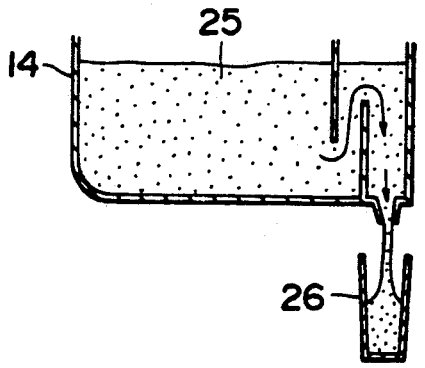
FIG. 3 is an explanatory view showing another discharge method for the residual molten material using an overflow system.

The discharge method of the residual molten material 25 from the heating vessel 14 may be of a bottom flow system such as shown in FIG. 2 or of an overflow system such as shown in FIG. 3. In either case, the residual molten material 25 is discharged into a vessel 26 for solidification and is left for cooling to obtain a highly volume-reduced solidified material.

EXAMPLE 1

A simulated nitric acid solution of a high-level radioactive waste in which radioactive nuclides were simulated by stable elements was prepared and was subjected to evaporation treatment to obtain a calcined material. The calcined material was then heated and reduced at a high temperature of 1,000° C. for 4 hours in a mixed gas stream of $H_2$-He(1:4). In the interim, Te, Cd, Se, Cs and Na were deposited in the cooling/collecting units and could be collected. The respective temperatures in the cooling/collecting units with respect to these elements were 200° to 600° C. for Te, 200° to 300° C. for Cd, about 600° C. for Se, 900° to 1,000° C. for Cs and 600° to 1,000° C. for Na.

EXAMPLE 2

The calcined material obtained after the heating and reducing treatment at the high temperature in Example 1 was further heat-treated at 850° to 1,050° C. in a vacuum. It was confirmed that Pd and Ru were deposited in the cooling/collecting units.

As is apparent from the foregoing, according to the method of the present invention, the high-level radioactive waste is heated, or reduction-heated, at a temperature to vaporize part of the elements contained in the radioactive waste and the resultant vapor was separated and collected. Therefore, in comparison with the prior art methods described hereinbefore, the method of the present invention has simplified treating steps, and does not need to add any special reagent or ion-exchange resin in the subsequent reprocessing or solidification step. Furthermore, since the collected elements are solids in the form of oxides or metals, they can be used as radiation sources or valuable metals, and can be subjected to transmutation without the need for complicated secondary treatment.

In addition, the solidified material obtained by the present invention hardly contains additives other than the nuclear fission products and actinides and has an extremely smaller occupying volume for storage and disposal than the conventional solidified materials and can drastically reduce the costs for storage and disposal. The solidified material can preferably be used as a radiation source for nuclear transformation by neutron irradiation, since its volume is small and the irradiation efficiency is high.

Although the present invention has been described with reference to the preferred embodiments thereof, many modifications and alterations may be made within the scope of the appended claims.

What is claimed is:

1. A method of treatment of a high-level radioactive waste of a nitric acid solution obtained as an extraction residue in reprocessing of spent nuclear fuels, said method consisting essentially of:

calcining the nitric acid solution to evaporate moisture and nitric acid in the solution to thereby obtain a calcined radioactive waste;

heating the calcined radioactive waste to a temperature ranging from about 500° to about 3,000° C. to vaporize a portion of the elements contained in the radioactive waste, the respective elements being vaporized in the form of metal or oxide thereof; and obtaining as a residue, a volume-reduced high-level radioactive solid.

2. The method according to claim 1, which further comprises cooling stepwise the resultant vapor at different temperatures each corresponding to the sublimation or boiling point of each metal or each oxide thereof to separately collect the respective elements.

3. A method of treatment of a high-level radioactive waste of a nitric acid solution obtained as an extraction residue in reprocessing of spent nuclear fuels, said method consisting essentially of:

calcining the nitric acid solution to evaporate moisture and nitric acid in the solution to thereby obtain a calcined radioactive waste;

heating the calcined radioactive waste in the presence of a reducing agent at a temperature ranging from about 500° to about 3,000° C. to vaporize a portion of the elements contained in the radioactive waste, the respective elements being vaporized in the form of metal; and obtaining as a residue, a volume-reduced high-level radioactive solid.

4. The method according to claim 3, which further comprises cooling stepwise the resultant vapor at different temperatures each corresponding to the sublimation or boiling point of each metal to separately collect the respective elements.

5. A method of treatment of a high-level radioactive waste of a nitric acid solution obtained as an extraction residue in reprocessing of spent nuclear fuels, said method consisting essentially of:

calcining the nitric acid solution to evaporate moisture and nitric acid in the solution to thereby obtain a calcined radioactive waste;

heating the calcined radioactive waste to a temperature ranging from about 500° to about 3,000° C. to vaporize a first portion of the elements contained in the radioactive waste, the respective elements being vaporized in the form of metal or oxide thereof;

heating the remaining radioactive waste in the presence of a reducing agent at a temperature ranging from about 500° to about 3,000° C. to vaporize a second portion of the elements contained in the remaining radioactive waste, the respective elements being vaporized in the form of metal; and obtaining as a residue, a volume-reduced high-level radioactive solid.

6. The method according to claim 5, which further comprises cooling stepwise the resultant vapor of the first portion of the elements at different temperatures each corresponding to the sublimation or oiling point of each metal or each oxide thereof to separately collect the first portion of the elements, and cooling stepwise the resultant vapor of the second portion of the elements at different temperatures each corresponding to the sublimation or boiling point of each metal to separately collect the second portion of the elements.

7. A method of treatment of a high-level radioactive waste of a nitric acid solution obtained as an extraction residue in reprocessing of spent nuclear fuels and containing cesium, strontium or cesium and strontium, said method consisting essentially of:

calcining the nitric acid solution to evaporate moisture and nitric acid in the solution to thereby obtain a calcined radioactive waste;

heating the calcined radioactive waste in the presence of a reducing agent at a temperature ranging from about 500° to about 3,000° C. to vaporize a portion of the elements contained in the radioactive waste, the respective elements being vaporized in the form of metal and including cesium, strontium or cesium and strontium; and obtaining as a residue, a volume-reduced high-level radioactive solid containing therein no cesium and strontium.

* * * * *